US009815175B2

(12) United States Patent
Miller

(10) Patent No.: US 9,815,175 B2
(45) Date of Patent: Nov. 14, 2017

(54) ABRASIVE ENTRAINMENT WATERJET CUTTING

(71) Applicant: G.D.O. INC, Elk River, MN (US)

(72) Inventor: Paul L Miller, Harvest, AL (US)

(73) Assignee: G.D.O. Inc, Elk River, MN (US)

( * ) Notice: Subject to any disclaimer, the term of this patent is extended or adjusted under 35 U.S.C. 154(b) by 0 days.

(21) Appl. No.: 15/237,578

(22) Filed: Aug. 15, 2016

(65) Prior Publication Data

US 2017/0151650 A1 Jun. 1, 2017

Related U.S. Application Data

(63) Continuation-in-part of application No. 14/036,639, filed on Sep. 25, 2013, now Pat. No. 9,446,500.

(51) Int. Cl.

| | |
|---|---|
| ***B24C 1/04*** | (2006.01) |
| ***B24C 7/00*** | (2006.01) |
| ***B24C 11/00*** | (2006.01) |

(52) U.S. Cl.

CPC ..... *B24C 7/0023* (2013.01); *B24C 1/045* (2013.01); *B24C 7/003* (2013.01); *B24C 11/005* (2013.01)

(58) Field of Classification Search

CPC ..... B24C 1/045; B24C 3/12; B24C 7/0015; B24C 7/0023; B24C 11/00; B24C 11/005

See application file for complete search history.

(56) References Cited

U.S. PATENT DOCUMENTS

| | | | | | |
|---|---|---|---|---|---|
| 2,985,050 | A * | 5/1961 | Schwacha | B26F 3/004 | 125/23.01 |
| 3,323,257 | A * | 6/1967 | Fonti | B24C 7/0007 | 451/101 |
| 4,555,872 | A * | 12/1985 | Yie | B05B 7/1431 | 451/102 |
| 5,065,551 | A * | 11/1991 | Fraser | B05B 7/1431 | 451/40 |
| 5,241,986 | A * | 9/1993 | Yie | B05B 1/306 | 137/512 |
| 5,363,603 | A * | 11/1994 | Miller | B24C 11/00 | 451/39 |
| 5,441,441 | A * | 8/1995 | Cook | B08B 3/02 | 451/36 |
| 5,524,545 | A * | 6/1996 | Miller | A62D 3/176 | 102/293 |
| 5,735,729 | A * | 4/1998 | Kobayashi | C09K 3/1463 | 451/36 |
| 5,785,581 | A * | 7/1998 | Settles | B24C 1/003 | 451/39 |
| 6,077,152 | A * | 6/2000 | Warehime | B24C 1/045 | 451/75 |
| 6,240,595 | B1 * | 6/2001 | Dupuy | B05B 15/0425 | 15/302 |
| 6,254,462 | B1 * | 7/2001 | Kelton | B24C 9/006 | 451/350 |
| 6,283,833 | B1 * | 9/2001 | Pao | B24C 5/04 | 451/102 |

(Continued)

*Primary Examiner* — Timothy V Eley

(74) *Attorney, Agent, or Firm* — Henry E. Naylor

(57) ABSTRACT

Abrasive entrainment waterjet technology to cut objects located above or below ground or above the surface of a body of water. Abrasive is conducted to an abrasive waterjet cutting head under the control of an abrasive feed and metering system that monitors the flow rate of abrasive.

28 Claims, 7 Drawing Sheets

(56) References Cited

U.S. PATENT DOCUMENTS

| | | | | |
|---|---|---|---|---|
| 6,656,014 | B2 * | 12/2003 | Aulson | B24C 1/045 451/2 |
| 6,886,444 | B2 * | 5/2005 | Reid | B24C 1/045 29/426.4 |
| 7,186,167 | B2 * | 3/2007 | Joslin | B24C 1/045 451/102 |
| 7,225,716 | B1 * | 6/2007 | Miller | F42B 33/062 86/50 |
| 7,300,336 | B1 * | 11/2007 | Nguyen | B24C 7/0053 451/101 |
| 8,123,591 | B2 * | 2/2012 | Olsen | B24B 57/02 451/2 |
| 8,371,903 | B2 * | 2/2013 | Goetsch | B24C 1/045 269/105 |
| 9,003,936 | B2 * | 4/2015 | Chillman | B24C 1/045 83/168 |
| 2007/0111642 | A1 * | 5/2007 | Davis | B24C 3/325 451/38 |
| 2010/0136888 | A1 * | 6/2010 | Bettazza | B24C 11/00 451/38 |
| 2011/0104991 | A1 * | 5/2011 | O'Donoghue | B24C 1/10 451/36 |
| 2012/0021676 | A1 * | 1/2012 | Schubert | B24C 1/045 451/38 |
| 2012/0252326 | A1 * | 10/2012 | Schubert | B24C 1/045 451/60 |
| 2012/0273277 | A1 * | 11/2012 | Blange | B24C 1/045 175/67 |
| 2014/0202684 | A1 * | 7/2014 | Danait | E21B 43/16 166/246 |

* cited by examiner

ABRASIVE ENTRAINMENT WATERJET CUTTING

CROSS-REFERENCE TO RELATED APPLICATIONS

This application is a Continuation-In-Part of Non-Provisional Ser. No. 14/036,639 which is based on Provisional Patent Applications 61/705,420 filed Sep. 25, 2012 and 61/826,078 filed May 22, 2013.

FIELD OF THE INVENTION

This invention relates to the use of abrasive entrainment waterjet technology to cut objects located above or below ground or above the surface of a body of water. Abrasive is conducted to an abrasive waterjet cutting head under the control of an abrasive feed and metering system that monitors the flow rate of abrasive.

BACKGROUND OF THE INVENTION

There is a demand for cutting of metals, stone, and other materials for such things as mining, salvage, rescue work, infrastructure development, and environmental remediation. Problems with flammability and material properties can hamper conventional cutting technologies. Non-limiting applications for safe vehicle mounted abrasive entrainment waterjet cutting systems include cutting pipeline; clearing passageways through rocks for communications and electrical power infrastructure; disposal of discarded military munitions (DMM), etc. Oxy-arc, oxy-fuel, oxy-hydrogen and arc cutting can be used to cut steels in non-hazardous locations. Mechanical drills and cutting tools, such as circular, ring, band, wire, and abrasive saws can also be used with varying degrees of success. None of these methods are easy to perform remotely and all have limitations that restrict their use. They are also generally hazardous to use around flammable or explosive materials, which are all too frequently found underground.

One conventional method of disposing of discarded military munitions is to detonate them in-situ using highly skilled personnel to place the necessary explosive charges. Unfortunately, serious contamination of the environment can occur with the dispersal of unreacted toxic chemicals. Abrasive entrainment waterjets have the potential of providing a safe and environmentally friendly alternative to conventional cutting technologies if certain obstacles can be overcome. Such obstacles include being able to feed a substantially steady flow of high-pressure water to the cutting head in certain remote locations.

The word "waterjet" is an ambiguous term used to broadly describe essentially any process that expels a liquid, regardless of pressure or fluid chemistry, through an orifice to form a fluid jet. The wide-ranging term of "waterjet" is used to include everything from low-pressure dental hygiene equipment to high-pressure systems incorporating abrasives that can cut through thick hardened steel and rock. In addition, a further confusion is introduced as the use of the word "water" in the term "waterjet" does not limit the application's use to only pure water ($H_2O$) as the fluid in the waterjet. In this context the word "water" can imply any fluid, any solution, and any solid material that will flow through an orifice under pressure or any gas that liquefies under pressure, such as ammonia, to form what should more precisely be termed a "fluid" jet, but by convention is defined in the trade as a "waterjet."

Waterjets are fast, flexible, reasonably precise, and are relatively easy to use. They use the technology of high-pressure water being forced through a small hole, typically called the "orifice" or "jewel" which is typically about 0.007" to 0.020" in diameter (0.18 to 0.4 mm), to concentrate an extreme amount of energy in a small area. The restriction of the tiny orifice creates high pressure and a high-velocity jet. The inlet (process) water for a pure waterjet is typically pressurized between 20,000 psi (138 MPa) and 60,000 psi (414 MPa). This is forced through the orifice or jewel which creates a very high-velocity, very thin jet of water traveling as close to the speed of sound.

Abrasive slurry waterjet, also known as an abrasive suspension jet, typically uses a hopper filled with abrasive, water, and a slurrying or suspension agent. This combined mixture is then pressurized and forced through the orifice of the waterjet cutting head. The abrasive slurry system must keep the abrasive in constant suspension, such as with use of chemical additives or by mechanical means, in order to prevent the abrasive from dropping out of suspension in the piping which leads to plugging and disabling of the system. Likewise, the flow of pressurized abrasive and water slurry mix is highly erosive to piping, valves, and fittings used in the system. In addition, one or more large pressure vessels must typically be used to contain a sufficient amount of abrasive slurry for cutting. Consequently, an abrasive slurry system is typically limited in pressure to approximately 140 MPa and normally operates at pressures closer to about 70 MPa.

An abrasive entrainment waterjet uses a high velocity fluid jet, formed by pressurized water passing through an orifice (jewel) of the cutting head resulting in a partial vacuum in a mixing chamber downstream of the orifice that aspirates and entrains abrasive particles that are introduced into the mixing chamber and into the fluid jet. Abrasive entrainment waterjet technology has several advantages over abrasive slurry waterjet technology. For example, it is more reliable; it requires less maintenance; it is able to operate at internal system pressures up to about 1,000 MPa or more; it can operate in a continuous mode rather than in a batch mode; it doesn't require expensive chemical additives; and it is able to operate with significantly lower abrasive consumption.

Waterjet technology has been used above ground and underwater for cutting metals and stone. For example, waterjets were taught as being effective in underwater mining operations. See Borkowski, P. and Borkowski, J. (2011). "Basis of High-pressure Water Jet Implementation for Poly-metallic Concretions Output from the Ocean's Bottom," *Rocznik Ochrony Środowiska* Selected full texts, 13, ppg. 65-82. An abrasive slurry system is taught as being capable of operating on remotely operated vehicles. Miller (U.S. Pat. No. 6,681,675) teaches using an abrasive entrainment waterjet on vehicles tethered to a stationary high-pressure water intensifier pump by a long hose. Unfortunately, the long hose limits the functional distance the waterjet can operate from the intensifier pump as well as severely limits the maneuverability of the waterjet carrying vehicle. Manders (U.S. Pat. No. 7,600,460) teaches a dedicated waterjet vehicle carrying a separate engine-pump combination for removing soil for exposing and defeating landmines.

While the art teaches the possibility of using waterjet technology for above or below ground cutting, there is still a need in the art for solving serious problems that exist and which must be overcome before such technology can be used commercially.

SUMMARY OF THE INVENTION

In accordance with the present invention there is provided a method for cutting objects located above or underground using an entrainment abrasive waterjet system, which method comprises:

a) providing a vehicle having multiple systems and an on-board hydraulic unit for operating at least one of its systems;

b) positioning an entrainment abrasive waterjet apparatus comprised of a hydraulically operated intensifier waterjet pump, an entrainment abrasive waterjet cutting head which cutting head comprising a mixing chamber, a process water inlet to said mixing chamber, and an abrasive feed inlet to said mixing chamber, which waterjet cutting head is in fluid communication with said intensifier waterjet pump and in fluid communication with a source of abrasive material, wherein said intensifier waterjet pump is operated by sharing the hydraulic system of said vehicle;

c) supplying a flow of water to said intensifier waterjet pump whereby the pressure of the flow of water is increased;

d) supplying a flow of abrasive material to said waterjet cutting head; and e) controlling the waterjet cutting head delivering a high velocity jet of water and abrasive to achieve a desired cutting track and rate of cutting of said object.

DETAILED DESCRIPTION OF THE INVENTION

Figure 1A:
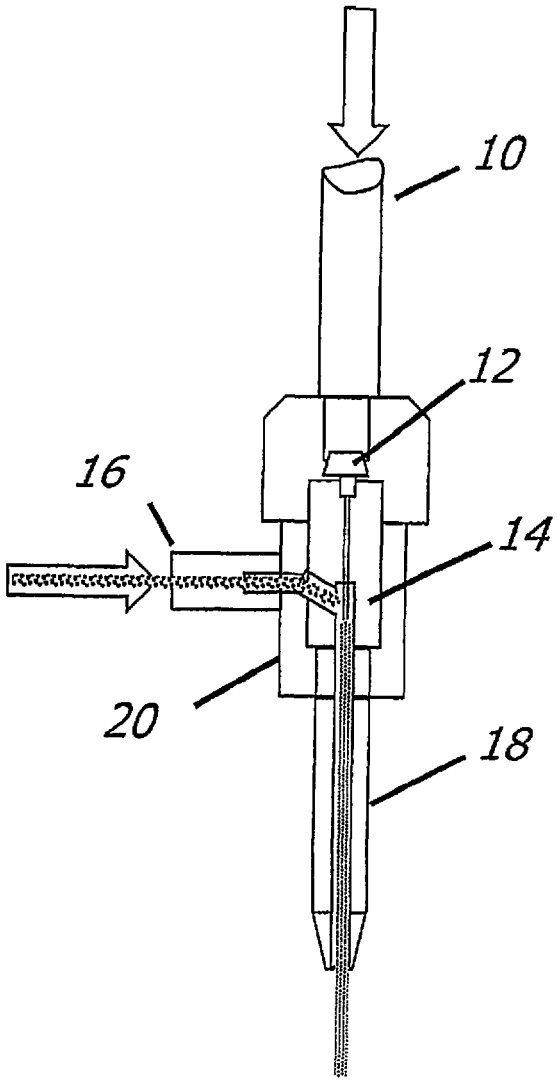
FIG. 1A hereof is a simplified representation of an entrainment abrasive waterjet cutting head and FIG. 1B is a block diagram of a method for feeding water and an abrasive to the waterjet cutting head of the present invention.
Figure 1B:
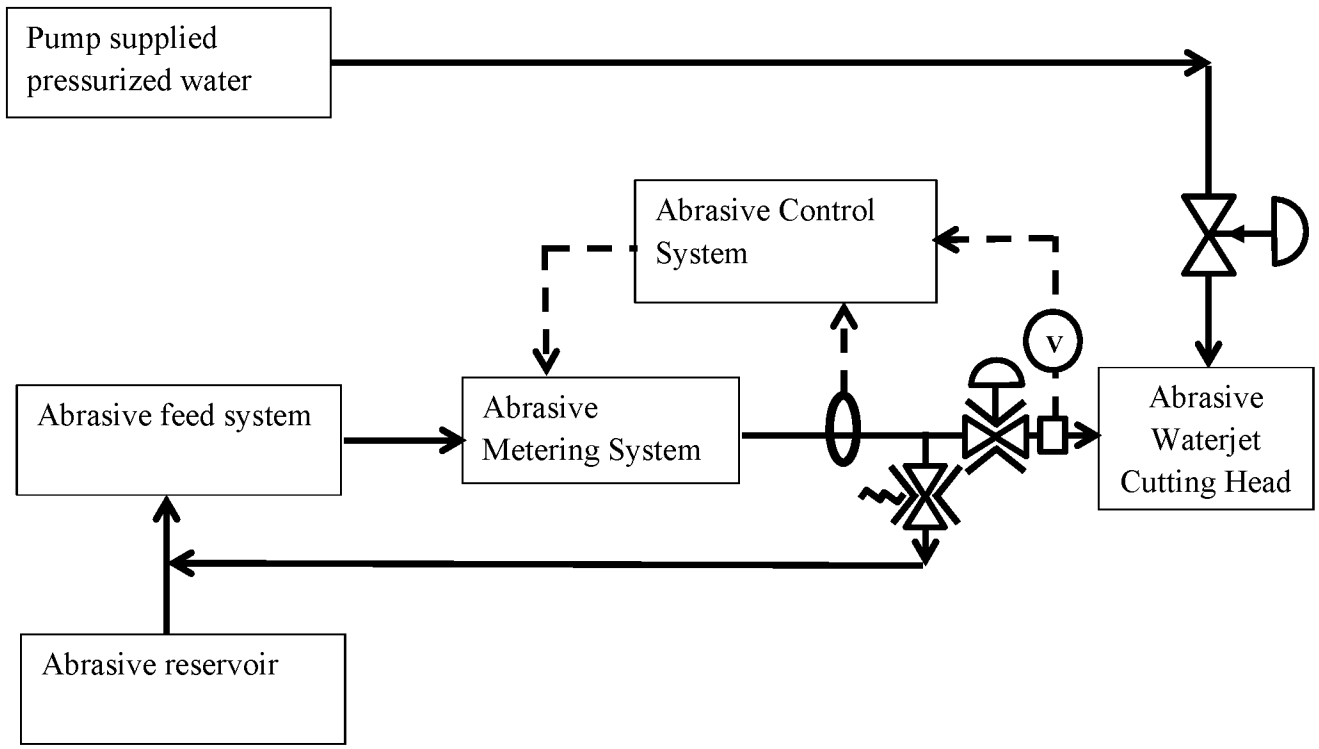

By "above or below ground", we mean that the object to be cut is found resting or is part of a structure essentially not submerged in a body of water. It is within the scope of this invention that the term "above or below ground" also includes the use of the waterjet system of the present invention on a structure secured within a body of water so that it has a working surface above the surface of water, or on a vessel, such as ship or barge, that floats on top of the surface of water.

Although any suitable ground or underground vehicle can be used in the practice of the present invention, for applications hazardous to humans it is preferred that the vehicle be an unmanned ground vehicle (UGV) which can be of the remotely operated type, of the autonomous type, or the semi-autonomous type. A remotely operated UGV is a vehicle that is controlled by a human operator via in interface. All actions are determined by the operator upon either direct visual observation or remote use of sensors such as digital video cameras. An autonomous UGV is essentially an autonomous robot that operates without the need for a human controller. The vehicle uses sensors to develop a limited understanding of the environment, which is then used by control algorithms to determine the next action to take in the context of a human provided mission goal. The semi-autonomous type is primarily human controlled, but can independently operate one or more portions of its systems. It is preferred that the UGV be of the remotely operated type.

The vehicle used in the practice of the present invention will include a hydraulic system which will be normal for such a vehicle or which is optional to run at least one of its functions. The intensifier pump of the waterjet system of the present invention will share a hydraulic system with the vehicle.

An abrasive entrainment waterjet has a distinct disadvantage as compared to abrasive slurry waterjet because the abrasive transport and feed system can be hampered, if not completely disrupted, if the suspension is destabilized by temperature, concentration, contamination, or just time.

In order to utilize the distinct advantages of abrasive entrainment waterjet technology over abrasive slurry waterjet technology and to be able to commercially operate, the following problems need to be addressed: i) supplying water at a pressure of at least about 200 MPa, preferably at least 250 MPa, more preferably at least 280 MPa to the waterjet cutting head; ii) supplying a measured and substantially continuous stream of abrasive to the abrasive waterjet cutting head; iii) preventing plugging or jamming of the abrasive waterjet cutting head; iv) attaching the abrasive waterjet cutting head to the targeted object; v) controlling the cutting of the abrasive waterjet cutting head on the targeted object and vi) in certain applications, such as accessing and disposal of hazardous materials or discarded military munitions waterjet wash-out of the contents of the targeted object accessed by the abrasive waterjet cutting head, and collecting the contents of the targeted object washed-out.

Supplying High Pressure Water

In a preferred embodiment of the present invention, the waterjet pump is an intensifier pump and it is powered by hydraulic power fed by hydraulic hoses from a vehicle's on-board hydraulic system, typically operating at pressures from about 14 MPa to about 105 MPa, preferably from about 14 MPa to about 35 MPa. Pressurized hydraulic oil is conducted to the waterjet pump and the resulting depressurized oil is returned to the vehicle's hydraulic oil reservoir. Preferred types of waterjet pumps for use in the present invention are intensifier pumps as opposed to reciprocating pumps. Waterjet intensifier pumps are well known in the art and utilize the so-called "intensification' principle.

A waterjet intensifier pump typically operates by having pressurized hydraulic oil flow into one side of a centrally located hydraulic piston having double ended piston rods extending into the high pressure water cylinders at each end, as shown in Glasgow (U.S. Pat. No. 3,070,023). The central hydraulic piston of the intensifier pump is typically 20 times the area of each piston rod giving a 20:1 intensification ratio. The piston rods, in turn, form the high pressure water pistons. Consequently, an application of 14 MPa hydraulic oil to the central hydraulic piston results in a twenty-fold intensification of pressure in the water cylinder and yields an outlet water pressure of 280 MPa. The outlet pressure of the water can be controlled by adjusting the inlet hydraulic oil pressure. When the centrally located hydraulic piston reaches the end of its stroke, a hydraulic valve body switches the flow of oil to the opposite side of the hydraulic piston and the process continues with the opposite water piston. The depressurized oil from the central cylinder is exhausted via the control valves to an exhaust port connected with an oil return to the surface.

It will be understood that a waterjet intensifier pump is only driven by a hydraulic fluid from a hydraulic pump. The hydraulic fluid can be any suitable fluid, preferably a hydraulic oil or water. The hydraulic pump can be thought of as a prime mover for the waterjet intensifier pump. A waterjet reciprocating pump would be driven by a prime mover other than a hydraulic pump.

Water, either fresh or seawater, can be pumped as the hydraulic fluid, pressurized to pressures of about 14 MPa to about 105 MPa to power the waterjet intensifier pump. It can then be discharged to the environment. The use of pressurized water has the advantages of not requiring the use of expensive hydraulic oil. It also eliminates the requirement of an oil return line, and minimizes the likelihood of an environmental discharge of hydraulic oil. Of course, the discharge of saltwater will more troublesome than the discharge of fresh or potable water.

In order to provide high pressure water with reduced wear and increased reliability of equipment, it is preferred to demineralize the process water that is used at high pressures. By process water we mean the water that is pressurized by the waterjet pump and used for cutting. It is preferred that the process water contains no more than about 350 parts per million total dissolved solids. In comparison, seawater is typically in the range of about 35 parts per thousand of dissolved solids. Process water can be supplied along in an umbilical cord bundle along with power and control cabling. As a second method, clean process water can be stored on the vehicle or in a separate storage container, either rigid or collapsible. The container can be mounted in a detachable larger container, or with one or more attachment points that will allow free movement of the vehicle to allow quick release for replenishment or in case of an emergency with the vehicle. The vehicle can be a telerobotically operated vehicle (TOV) that can be controlled remotely by an operator. Typical TOVs are equipped with hydraulic manipulators, a vision system, and a remote control system to allow the operator to maneuver the TOV to a desired location to perform its intended task. The vehicle can be an operator operated vehicle (OOV), under direct control of an operator present in the vehicle, or an autonomous vehicle (AV) under control of a computer either running a software routine or an artificial intelligence program.

Another method is to filter groundwater, if present. A preferred aspect of this method is the use of a reverse osmosis (RO) membrane unit, preferably in combination with one or more prefilters, preferably a 10-30 micron prefilter(s) to demineralize groundwater. This will substantially improve the quality of the process water. RO systems remove such things as salts, microorganisms and many high molecular weight organics. The RO process water can be used as produced or it can be stored in a separate storage container, either rigid or collapsible. RO is a membrane separation process in which feed water flows along the membrane surface under pressure. Purified water permeates the membrane and is collected, while the concentrated water, containing dissolved salts and un-dissolved material that do not flow through the membrane, is discharged. The reverse osmosis membrane of the reverse osmosis unit(s) can be any of those known in the art. Reverse osmosis membranes can be divided into two categories: (1) asymmetric membranes prepared from a single polymeric material and (2) thin-film composite membranes prepared from a first and a second polymeric material. Asymmetric membranes typically have a dense polymeric discriminating layer supported on a porous support formed from the same polymeric material. The dense skin layer determines the flux and selectivity of the membrane while the porous sub-layer serves only as a mechanical support for the skin layer. Non-limiting examples include asymmetric cellulose acetate membranes. Thin-film composite membranes comprise a permselective discriminating layer formed from a first polymeric material anchored onto a porous support material formed from a second polymeric material. Generally, the permselective discriminating layer is comprised of a cross-linked polymeric material, for example, a cross-linked aromatic polyamide. Suitably, the porous support material is comprised of a polysulfone. Polyamide thin-film composite membranes are more commonly used in reverse osmosis desalination plants since they typically have higher water fluxes, salt and organic rejections and can withstand higher temperatures and larger pH variations than asymmetric cellulose acetate membranes. The polyamide thin-film composite membranes are also less susceptible to biological attack and compaction. The reverse osmosis membrane should at least be capable of preventing significant amounts of dissolved solids from entering the treated low salinity water product stream while allowing the water solvent to pass across it. Preferably, the membrane of the reverse osmosis unit is a spiral wound membrane located within a housing.

Another method to produce clean process water is to electrolytically generate it from groundwater, brackish water, or seawater. The electrolytically generated water can be generated on the vehicle. One non-limiting example is Proton's HOGEN C Series C30 Proton Exchange Membrane (PEM) electrolysis unit, which can provide process water at a high purity.

It is preferred that high pressure hydraulic fluid be powered by the vehicle's on-board hydraulic system and used to power the high pressure waterjet intensifier pump. The hydraulic power attachment can be made through a conventional connection, such as through standard quick-disconnect fittings, such as Parker FH Series Couplings, or similar hydraulic connections know to those skilled in the art. The waterjet pump can be mounted on the vehicle or mounted as an accessory unit in a separate fixture that the vehicle can pick up and put down as required.

Supplying Abrasive to the Abrasive Waterjet Cutting Head

An abrasive entrainment waterjet starts out the same as a non-abrasive waterjet. But with an abrasive entrainment waterjet, the jet of water accelerates abrasive particles to speeds fast enough to cut through very hard materials. The cutting action of an abrasive waterjet is two-fold. The force of the water and abrasive erodes the material, even if the jet is held stationary (which is how an object is initially pierced). Any suitable entrainment abrasive waterjet cutting head can be used in the practice of the present invention. FIG. 1A hereof is a simplified representation of such a cutting head which shows water inlet 10, jewel orifice 12, mixing chamber 14, abrasive inlet 16, mixing tube or nozzle 18 and nozzle nut 20. The high-velocity jet of water exiting the jewel orifice 12 creates a vacuum that pull abrasive from abrasive inlet line 16, which then mixes with the jet of water in mixing chamber 14 and it jetted out of the mixing nozzle 18. The cutting action is greatly enhanced when the abrasive waterjet stream is moved across the intended cutting path of the object. The ideal speed of cutting depends on a variety of factors, including but not limited to the hardness of the object being cut, the shape of the object, the waterjet pressure, and the type of abrasive. Controlling the speed of the abrasive waterjet cutting head is important to efficient and economical cutting.

Non-limiting examples of abrasive materials that are suitable for use in the present invention include glass, silica, alumina, silicon carbide aluminum-based materials, garnet, as well as elemental metal and metal alloy slags and grits.

Preferred are garnet and aluminum-based materials. It is preferred that the abrasive particles have either sharp edges or that they be capable of fracturing into pieces having sharp cutting edges, such as for example, octahedron or dodecahedron shaped particles. The size of the abrasive particles may be any suitable effective size. By effective size, is meant a size that will not plug the cutting head and that will be effective for removing the material of which the targeted object to be cut is made from (typically a metal alloy, such a steel) and which is effective for forming a substantially homogeneous mixture with the fluid carrier. Useful particle sizes for the abrasive material will range from about 3 mm to 55 microns, preferably from about 15 mm to 105 microns, and most preferably from about 125 microns to about 250 microns.

There are several ways in accordance with the present invention for the abrasive to be incorporated into the waterjet cutting head without jamming or plugging. For example, in dry locations a storage vessel can supply dry abrasive via a hose to the waterjet cutting head. A braided metal hose is preferred to prevent the hose from crushing during operation. The aspiration of the mixing chamber in the entrainment abrasive waterjet cutting head will provide sufficient suction to entrain the abrasive from the storage vessel.

An excess of internal air or gas pressure in the abrasive system will try to force an excess amount of abrasive into the abrasive waterjet cutting head, which is both wasteful and can potentially plug the abrasive waterjet cutting head.

As an alternative to a large abrasive reservoir, a smaller reservoir can be used and periodically refilled using a dedicated abrasive supply line, or the same airline that supplies compressed gas by adding abrasive to the airline. An abrasive bypass valve can be actuated by the abrasive control system to allow the abrasive to bypass the air pressure regulator and go directly into the abrasive reservoir.

Another alternative to using compressed gas from a vehicle mounted air compressor is to use dry compressed gas that can be supplied as a compressed or liquefied gas in an appropriate pressure storage vessel co-located with the abrasive waterjet cutting head and metered through a pressure reduction valve. The pressure reduction valve can be either a single stage or double stage reduction valve. A double stage reduction valve can be thought of as two single stage valves in series with different set points. The reduction valves work by having an adjustable spring biased diaphragm that mechanically moves in relationship to the pressure applied on each side of the diaphragm. The spring bias allows for setting a specific pressure. When pressure is applied to one side of the diaphragm, it moves and pushes on its control linkage causing an increased flow and pressure of pressurized gas until the amount of pressure balances out the spring bias. In the case of a two stage gas regulators, the initial valve is preset and is not typically adjusted in the field. The advantage of using a two-stage gas regulator is a more constant gas pressure as compared to a single stage regulator.

Compressed dry gas for the abrasive system is preferably substantially oxygen-free, more preferably if is comprised of nitrogen or argon, to minimize the effects of compressed oxygen on combustible materials, such as propellants, explosives, or pyrotechnics. The substantially oxygen-free gas can be purchased from third party suppliers or it can be produced on site from the atmosphere by use of any suitable gas separation technology. Non-limiting gas separation technologies that can be used include pressure swing adsorption (PSA), vacuum swing adsorption (VSA), membrane separation, or cryogenic separation. The separated gas is supplied by a gas supply line to the abrasive waterjet cutting system.

The abrasive can be metered using a programmable electronic or mechanical device, known as the abrasive feed control system that will allow precise control over the quantity of abrasive mix being fed to the abrasive waterjet cutting head. In one preferred embodiment a microprocessor-based system is used. A mechanical logic control system can also be used. Non-limiting types of mechanical logic control systems include fluidic, pneumatic, and mechanical logic processing.

The metering system for the abrasive can use a number of several types of feed systems. Non-limiting examples of types of feed systems suitable for use herein include incremental feeders using a rotary screw auger, containing either a spiral blade coiled around a shaft, driven at one end and held at the other, or a shaft-less or center-less spiral flight, powered by electrical, mechanical, hydraulic, or pneumatic means under fixed control or under the control of the abrasive control system. The abrasive mix feeder can also utilize mechanical such as piston feed systems, or other increment feeders, such as belt feed, bucket feed, reciprocating feed, or oscillating feed, etc.

The abrasives used in the practice of the present invention can be paramagnetic. Non-limiting examples of paramagnetic abrasive materials that can be used in the practice of the present invention include pure crystals or crystalline mixtures of pyrope, almandine, spessarite, silicon carbide, etc., exhibit paramagnetism and will react to magnetic fields. Paramagnetic abrasives can also be metered by using a rotating magnetic disk or cylinder, using either electromagnetic or permanent magnets, that will feed a measured flow of paramagnetic abrasive mix based on the rotating speed and/or magnetic flux under the control of the above mentioned abrasive control system.

The flow of abrasives to the abrasive waterjet cutting head must be a substantially constant, uniform flow despite changes in temperature and pressure in the abrasive reservoir. The abrasive metering device must be able to control the flow of abrasive and meter it uniformly into the abrasive waterjet cutting head or its abrasive delivery tube.

Preventing Plugging or Jamming of the Abrasive Waterjet Cutting Head

Figure 2A:
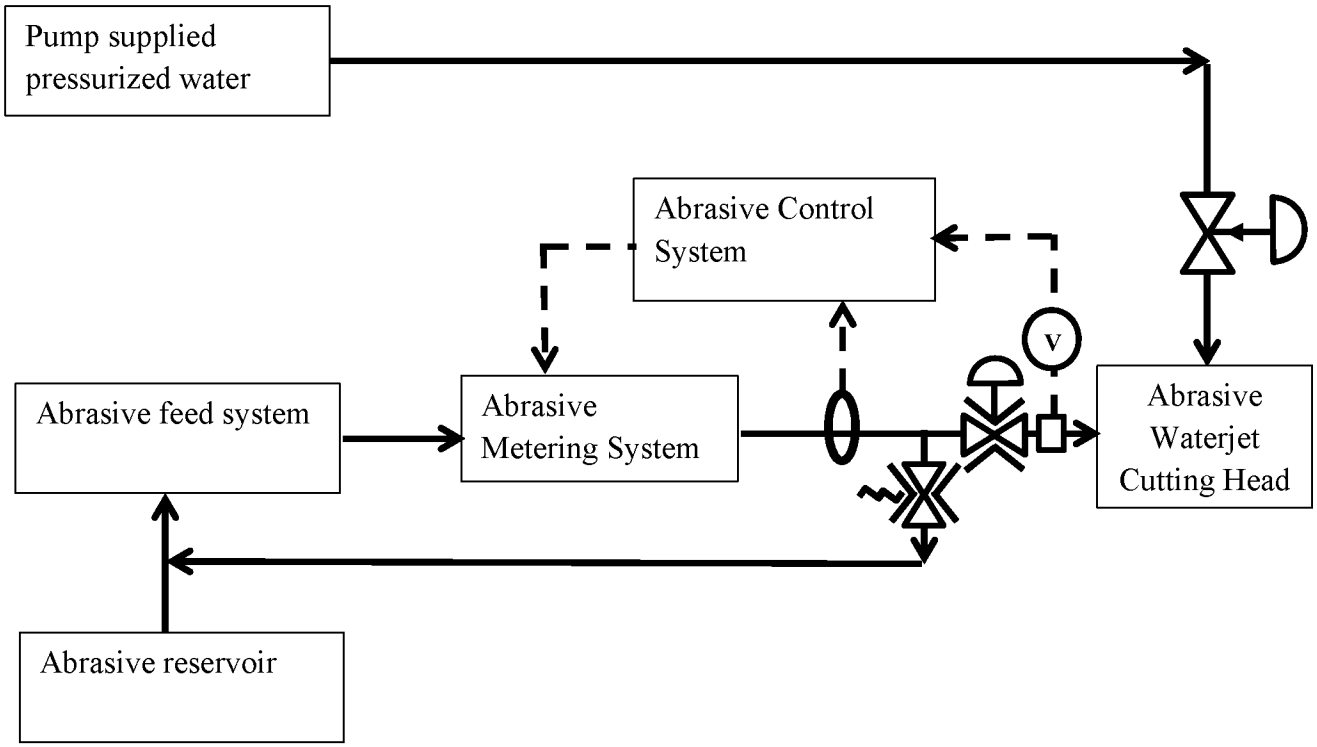
FIGS. 2A, 2B, and 2C represent preferred embodiments for controlling the mass flow of abrasive and preventing plugging of abrasive at the waterjet cutting head.

The feeding of abrasive into the abrasive waterjet cutting head is important for the operation of the abrasive waterjet cutting head and the cutting operation. Consequently, a method to prevent plugging of the abrasive in the feed and metering system to the abrasive mixing chamber of the cutting head is preferred. Such methods can include one or more of the following concepts:

(A) The plugging of the abrasive mix can be minimized by using a continuous loop feed system as illustrated in FIG. 2A hereof that continuously feeds the abrasive mix from the abrasive feed and metering system to the abrasive waterjet cutting head and returns an unused portion of abrasive mix back to the abrasive feed and metering system. A substantially constant flow of abrasive mix will minimize the likelihood of abrasive settling or plugging.

Figure 2B:
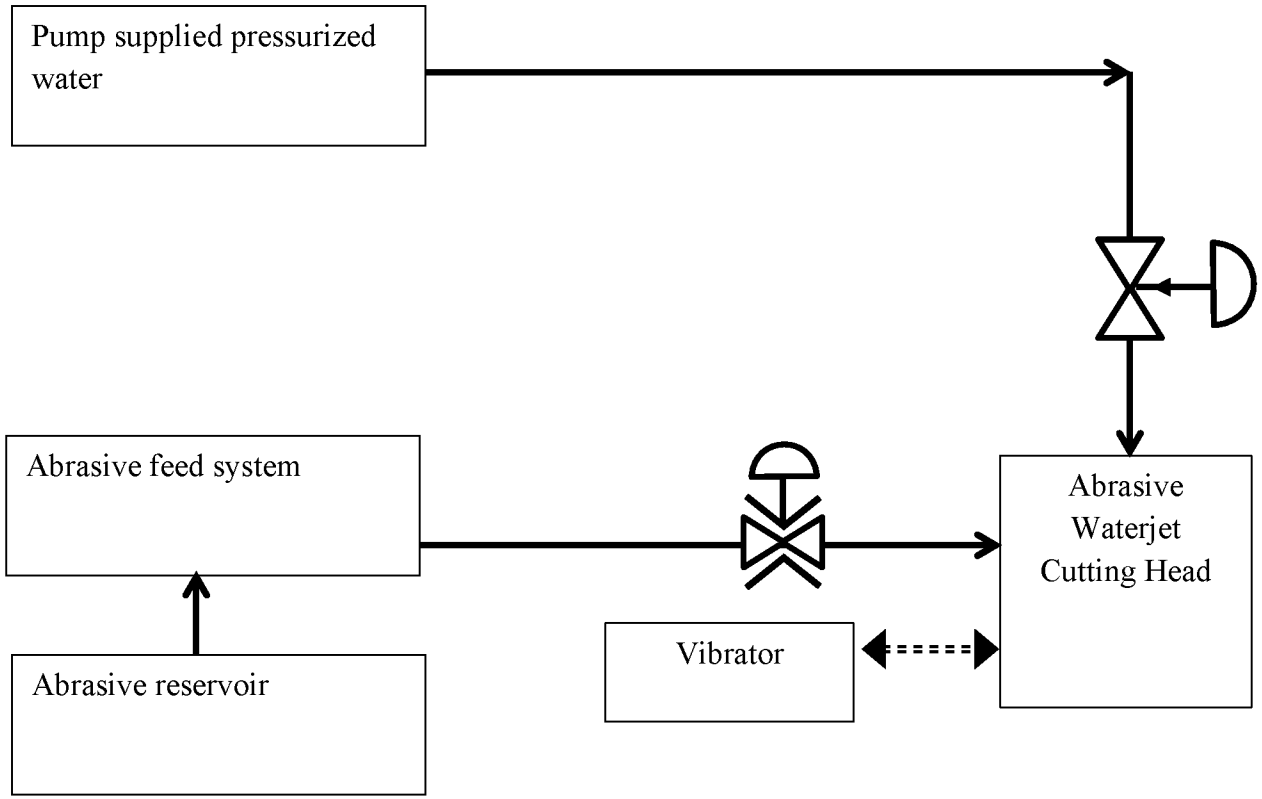

(B) The plugging of abrasive mix can be minimized by the addition of mechanical vibration as illustrated in FIG. 2B hereof at the abrasive waterjet cutting head to prevent agglomeration of abrasive particles. The vibration can be applied by any suitable conventional means such as by use of electrical, hydraulic, or pneumatic power sources. In the case of electrically induced vibrations, the vibration can be induced by a rotary electric motor with an offset mass causing vibration during rotation; a rotary electric motor causing a cam to lift and drop a spring loaded mass; an electrical signal applied to a solenoid to act either as a linear oscillating mass or as an impacting mass; an electrical signal applied to an electromagnet causing acoustic vibrations; an electric signal applied to an electromagnet with the attracted core attached to a part of the abrasive waterjet cutting head causing oscillating vibrations. In the case of hydraulic or pneumatic systems, the vibration can be induced by a rotary hydraulic or pneumatic motor with an offset mass causing vibration during rotation; a rotary hydraulic or pneumatic motor causing a cam to lift and drop a spring loaded mass; or a hydraulic or pneumatic piston oscillating and acting as a linear oscillating mass or as an impacting mass. Other variations are also applicable. Vibration will also improve the cutting speed of the abrasive waterjet cutting process by preventing stagnation of the jet of water and abrasive at the cutting zone.

Figure 2C:
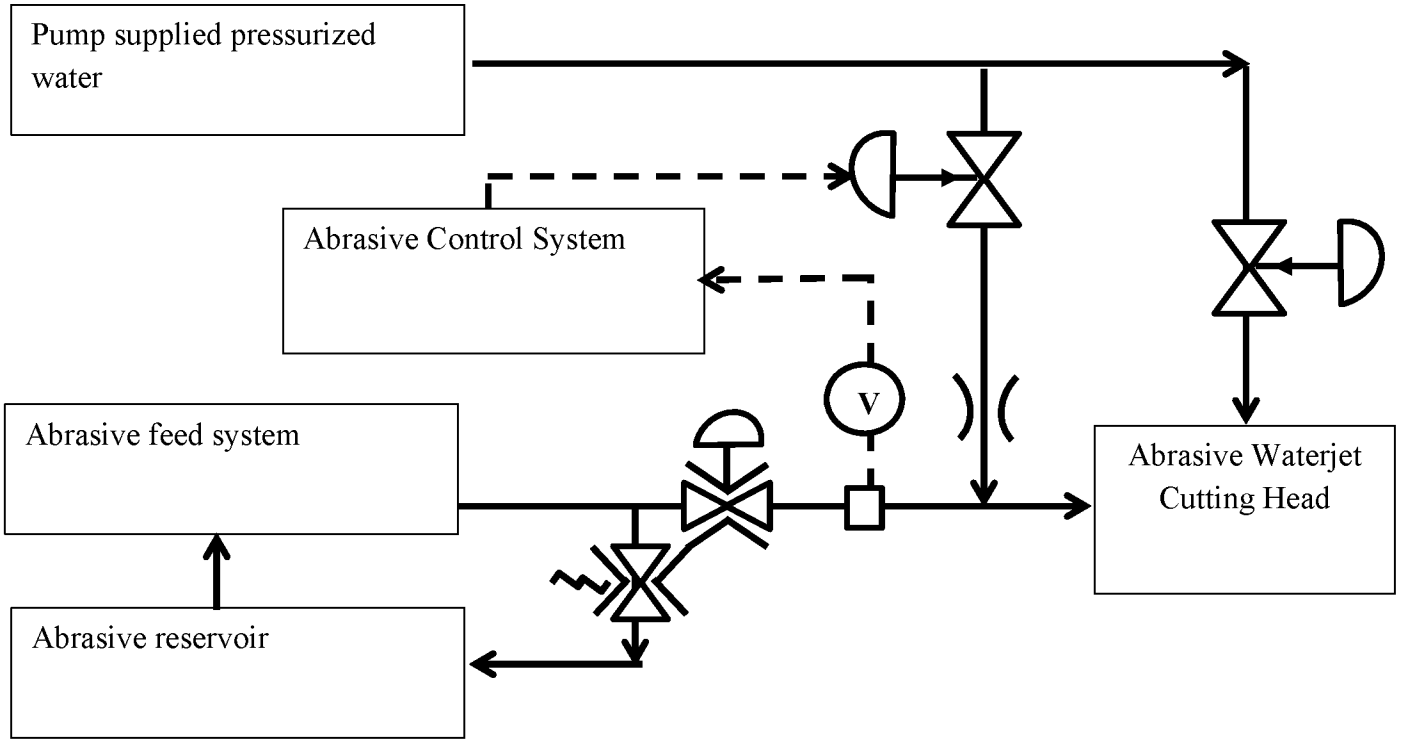

(C) An abrasive mix plug or jam, once detected, preferably by using a vacuum sensor to detect loss of vacuum formed by venturi action of the water jet, can be removed as illustrated in FIG. 2C hereof by upstream injection of supplemental water to dilute the abrasive mix using a by-pass stream of water from the high-pressure water delivery line. The high-pressure water is controlled by the abrasive control system, which injects an effective amount of water to dilute the abrasive mix and flush out any agglomeration.

Figure 3A:
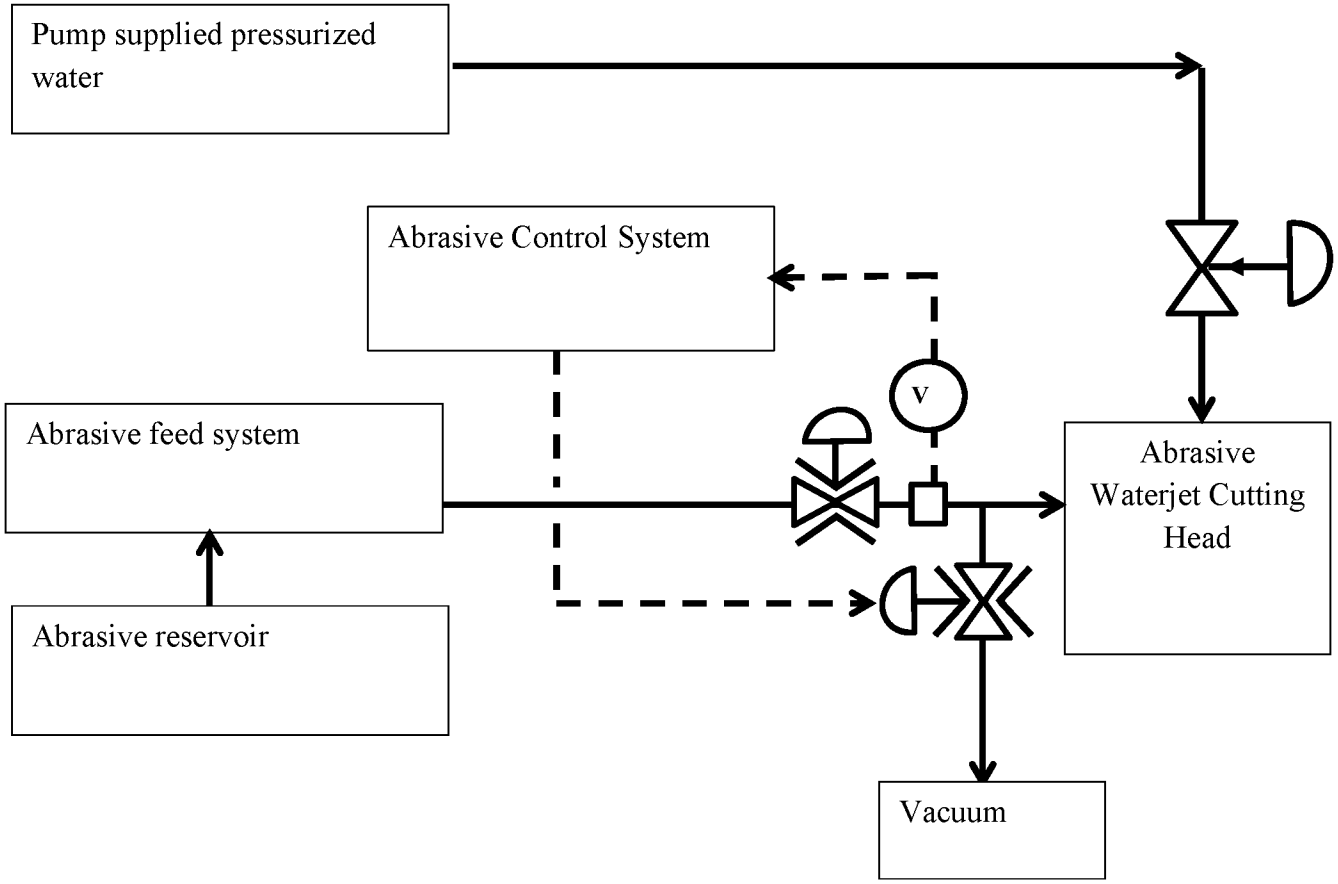
FIGS. 3A and 3B represent additional preferred embodiments for controlling the mass flow of abrasive and preventing plugging of abrasive at the waterjet cutting head.
Figure 3B:
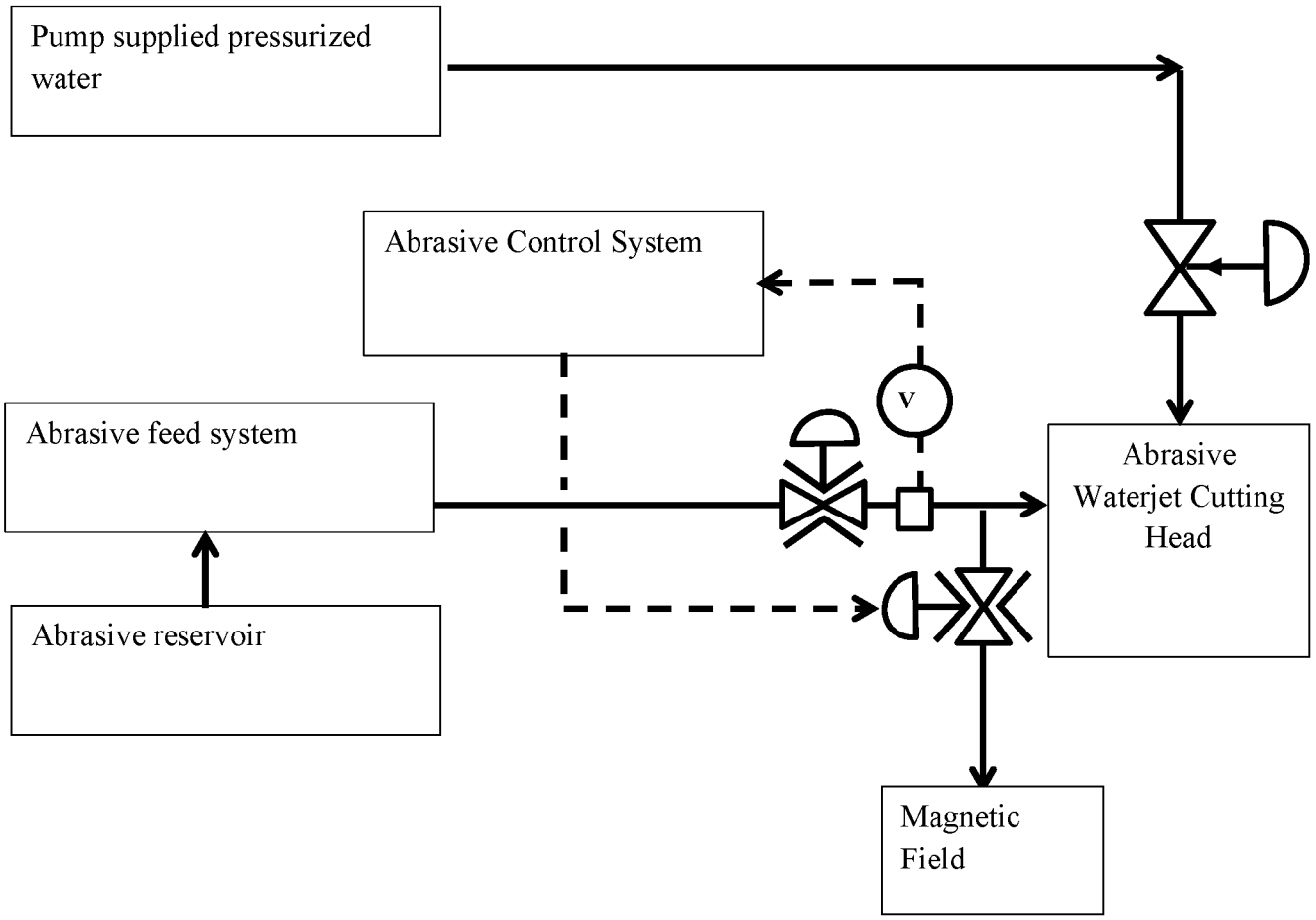

A plug of abrasive mix, once detected, can also be removed by the application of supplementary vacuum as illustrated in FIG. 3A hereof from another port near to the abrasive mixing chamber, or by supplementary vacuum on the continuous loop feed system. A plug of paramagnetic abrasive mix, once detected, can be removed as illustrated in FIG. 3B hereof by the application of supplementary high level magnetic force from another port near to the abrasive mixing chamber, or by supplementary magnetic force on the continuous loop feed system if used.

Attaching the Abrasive Waterjet Cutting Head to the Targeted Object.

Although the abrasive waterjet cutting head can be held by either a human or attached to the vehicle, such as in Manders (U.S. Pat. No. 7,600,460) and moved along a cutting tract of the targeted object, it will, in most instances, need to be attached to the targeted object for an accurate cut to be made. The abrasive waterjet cutting attachment is accurately positioned in relation to the targeted object in order for the object to be properly cut and/or washed out. Small objects to be cut, weighing less than approximately 5.4 kg (12 lb), may need to be immobilized to prevent movement during the high-pressure entrainment abrasive waterjet cutting process. Large abrasive waterjet cutters use waterjets yielding approximately 54 N (12 lbf) which can physically move smaller objects.

There are various methods in accordance with the present invention wherein lightweight objects can be immobilized for the cutting operation. Non-limiting examples of such methods include the placement of a bag filled with pellets, the use of a heavy weight contoured to fit the shape of the object to be cut, the use of a plurality of free-flowing pellets or stones and the like placed on top of the object, the pellets can be solid or a gel; and the use of magnetic pellets or pellets comprised of a ferro-fluid being lowered to the object by an electromagnet which releases the pellets so they rest on top of the object. These paramagnetic materials have the advantage of being recoverable after cutting by using an electromagnet or a permanent magnet on board the vehicle.

Pellets can also be made of a high density fluid or slurry, preferably encapsulated, within a deformable polymeric shell. The polymeric shell can be formed from any suitable pliable polymer, preferably a silicone rubber, that will have a relatively low shore durometer hardness, preferably in the range of about 20 to about 100 Shore A, more preferably from about 50 to about 75 Shore A. The advantage of these deformable pellets is that they can more closely configure themselves to the contour(s) of the targeted object. The high density fluid or slurry can be made from magneto-rheological material(s), such as "ferro-fluids," that will allow for the ability to recover the pellets with use of a magnetic force after the cutting process is finished.

Another method for immobilizing a lightweight item is by releasing a fast setting material, such as hydraulic cement. Non-limiting examples of hydraulic cements that are suitable for use in the present invention include are Portland and pozzolanic cements. Yet another method for immobilizing a lightweight object is to release a two-part reactive material such as epoxy or silicone.

Finally, another method for immobilizing a lightweight object is to release a plastic or thermoplastic material, such as hot-melt polyester adhesive. Such materials are liquefied by using a heat source, such as an electrical resistance heater or by using heat from hot hydraulic system oil, and applying them to the targeted object to adhere it to the sea floor or to provide sufficient mass to resist the effects of the waterjet.

Once the targeted object is immobilized, or is large enough so that it does not requiring immobilization, the abrasive waterjet cutting system can be attached to the targeted object by any suitable means. Prior to attaching the abrasive waterjet cutting head to an object that is covered with excessive biological growth or corrosion protuberances, the waterjet can be used to clean off the surface of the targeted object, thereby leaving a smoother surface.

In one embodiment of the present invention, the abrasive waterjet cutting head can be attached with a plurality of free-flowing pellets including magnetic pellets or pellets comprised of a ferro-fluid which is placed on top of the object to the cut by use of an electromagnet which releases the pellets so they rest on top of the abrasive waterjet cutting system. These paramagnetic materials have the advantage of being recoverable after cutting by using an electromagnet or a permanent magnet on board the vehicle.

Another method for attaching the abrasive waterjet cutting head to the targeted object is to use magnetic attraction, either using electromagnets or permanent magnets. This method will only be used on ferromagnetic or paramagnetic targeted objects. This method can use either a conformal pad, typically made from polymeric materials, or a hard mount directly to the targeted object to achieve the desired attachment force of about 54 N (12 lbf) force. The conformal pad shore durometer hardness is preferably in the range of 20 to 100 Shore A, with 50-75 Shore A being most desirable.

Yet another method in accordance with the present invention for attaching the abrasive waterjet cutting head to the targeted object is by use of an adhesive. For example, attaching an obturating ring made from a one or more polymer materials, such as polyurethane or polymethylmethacrylate (PMMA), that is catalyzed forming a conformal fit on the targeted object and would attaching to the abrasive waterjet cutting head assembly to the target item.

Another method is to use an adhesive material dispensed from a delivery systems and applied to the targeted item to attach to the abrasive waterjet cutting head. Non-limiting examples of suitable adhesives include those of a thermoplastic material, such as ethylene n-butyl acrylate (EnBA), ethylene-acrylic acid (EAA), and ethylene-ethyl acetate (EEA), adhesives. The heat for softening the thermoplastic materials in the delivery system can be provided by any suitable conventional means, such as by electric resistance heating, hot fluid, such as hot hydraulic fluid, or by an exothermic reaction between two or more chemicals. The thermoplastic material is heated to a significantly higher temperature than its melting temperature so that it doesn't immediately freeze when injected in the cold environment. The temperature the thermoplastic material is heated to will determine the speed the adhesive sets in the cold environment, but the temperature must be less than the thermoplastic material's decomposition temperature.

In another embodiment of the present invention, the abrasive waterjet cutting head can be attached by use of suction pads, either contoured to fit the general configuration of the targeted object, or of a commercial configuration that is small enough to allow sufficient pad attachment surface area to withstand the reaction force of the abrasive waterjet. A nominal attachment force is about 54 N (12 lbf (pound-force)), but can vary due to the size of the abrasive waterjet orifice and/or water pressure. The suction pads can be actuated by inducing a lower pressure within the pad area via a pump or by a retractable piston, creating a lower pressure within the pad area. As a non-limiting example, using a 40×80 mm Vuototecnica VES 40 80S silicone vacuum pad with 17 kPa (2.5 psi) pressure differential between the inside and outside of the pad will give an attachment force of about 54 N (12 lbf). The conformal area of the suction pad also provides a seal to prevent or minimize the egress of materials from the targeted item from entering the environment.

Yet another class of attachment devices is to use mechanical means to attach the abrasive waterjet cutting head assembly to the target object. These methods include using mechanical clamps, bands, and chains to grip the surface and restrain the abrasive waterjet cutting head assembly.

Another method for attaching the abrasive waterjet cutting head to the targeted object is to use movable fixtures that have their own means of attachment to the targeted object. For example, a wheeled fixture using a plurality of suction pads can be used, or a plurality of permanent or electromagnets on the wheels. Still another method for attaching the movable fixtures to the targeted object is to use a movable track, containing a plurality of permanent or electromagnets on the track.

Controlling the Cutting of the Abrasive Waterjet Cutting Head.

Once the abrasive waterjet cutting head has been securely attached to the targeted object, a cutting control system, either autonomously or under the control of an operator, can energize the waterjet by allowing pressurized water to flow through the waterjet cutting head orifice to form the jet of water. The cutting control system will then verify that the jet of water has formed a sufficient vacuum in the abrasive mixing chamber measured, via a vacuum or pressure transducer, prior to energizing the abrasive feed and metering system using the abrasive control system. Once abrasive has been fed to the abrasive waterjet cutting head, the control system will continue to monitor the vacuum in the mixing chamber of the cutting head for abnormalities. The typical vacuum in an abrasive waterjet cutting head is approximately 27 to 29 inches of mercury.

It is preferred that once attached to the targeted object, the abrasive waterjet cutting head is maintained at a predetermined standoff distance from the targeted object of approximately 0 to 13 mm, preferably from about 2 to 4 mm for optimal performance. Greater or lesser distances will affect the performance of the abrasive waterjet cutting process. This distance can be maintained by using either active or passive height adjustment systems.

The simplest system for maintaining a functional standoff distance is to passively pre-align the abrasive waterjet cutting head to the desired height, plus some estimate for the target's topology, and operate it, within a safe, but not necessarily optimal, operational envelope. A more accurate method is to utilize an active terrain following probe such as a tracking wheel, that actively monitors the target's topology and moves the cutting head by mechanical, hydraulic, pneumatic, or electrical actuators to roughly optimize the standoff distance from the target. Another more accurate method is to use a computerized control system that adapts the height of the abrasive waterjet cutting head as it traverses the target by means of mechanical, hydraulic, pneumatic, or electrical actuators to maintain the optimal standoff distance. The computer control system monitors the target surface information and the cutting head's speed and direction. The information is then stored in the computer memory forming a three-dimensional map of the target's terrain that is constantly updated as the cutting progresses. Control signals are then made to the mechanical, hydraulic, pneumatic, or electrical actuators to raise or lower the cutting head as needed in anticipation of changes in the target's topology.

Input to the cutting head standoff control system can be made by the use of laser range finder, preferably using a short wavelength light in the blue-violet spectrum, to provide accurate standoff distance prediction. As an alternative, high-frequency acoustic range finding can be used, preferably in the 25 kHz and above range, to accurately determine the standoff distance, and to provide that information to the control system. Yet another alternative is to utilize one or more spring loaded pin(s), that provides a standoff depth gauge(s) that compress against the targeted object and generates a variable electrical signal, such as changing the resistance in the sensor by moving a potentiometer that can feed information back to the control system.

Once the correct standoff distance has been determined, the abrasive waterjet cutting head can be moved in a predetermined path for cutting the targeted object by using mechanical, hydraulic, pneumatic, or electrical motors to propel the mechanism by gear, chain, belt, cable, screw, or track. For example, an external gear can be engaged for driving the abrasive waterjet cutting head through a predetermined, preferably a circular, path to cut an opening. Likewise, the abrasive waterjet cutting head can be controlled using a one or more powered axes under the control of a computerized control system or controlled directly by an operator. Although a linear cut, or a circular access hole, is expected to be the typical geometry of the abrasive waterjet cutting, a hole of any geometrical shape can be used.

Waterjet Wash-Out of the Contents of the Targeted Object.

In certain cases, the cutting of the targeted object will be only one of several steps necessary to properly process the targeted object. In certain circumstances the targeted object may need to be drained and "washed out" to remove its contents for recovery or disposal. For example, the contents of a building may be valuable enough to be recovered, or the explosive contents of a DMM may be hazardous enough to warrant removal for safety, toxicity, or counter-terrorism reasons.

In order to properly washout the contents of the targeted object, the plug around which a cut was made from the targeted object will have to be removed. There are several methods in accordance with the present invention that can be used to remove this plug. For example, in one method the attachment of the abrasive waterjet cutting head mechanism can be strategically placed in a sloped or inverted position so that gravity will help remove the plug from the access hole.

A suction pad can also be used to extract the cut plug. A third method is to use a magnetic attachment, either using a permanent magnet or an electromagnet, to attach to the plug, if it is ferromagnetic or paramagnetic. A fourth method is to apply an adhesive material to the plug so that an actuator can be used to remove and extract the cut plug. Non-limiting examples of suitable adhesives include those of a thermoplastic material, such as ethylene n-butyl acrylate (EnBA), ethylene-acrylic acid (EAA), and ethylene-ethyl acetate (EEA), adhesives. The heat for softening the thermoplastic material can be provided by any suitable conventional means, such as by electric resistance heating, hot fluid, such as hot hydraulic fluid, or by an exothermic reaction between two or more chemicals. Alternatively, the adhesive can be made from a one or more parts polymer materials, such as polyurethane or polymethylmethacrylate (PMMA), that is catalyzed with a suitable catalyst to form an effective bond.

Once the access hole has been formed and the plug is removed, the washout process can proceed. In some cases, the abrasive waterjet cutting head can be used to act as a washout jet by continuing to spray water, with or without abrasive, into the targeted object's interior. Although this process may not be optimum, it is adequate for such materials as liquids and low melting point materials.

Another preferred method for removing materials from the targeted object's internal cavity is to introduce a secondary waterjet lance, wand, or other suitable tool that is specifically designed to direct water flow in the direction of the target object's internal mass. For example, the removal of residual materials within a pipe will typically require one or more "side-firing" jet(s) in the nozzle body attached to the washout wand for an access hole made perpendicular to the long axis of the pipe. Alternatively, the nozzle body attached to the washout wand for an access hole made co-axially to the pipe may have a preponderance of "end-firing" jet(s) to remove the mass of residual materials.

The waterjet washout lance, wand, or other suitable tool uses high pressure water, in the range of about 280 MPa to 1,000 MPa, preferably 380 MPa to 600 MPa, forced through one or more orifices to form high velocity droplets that act as kinetic impactors to erode and fragment the targeted object's internal mass. The resulting fractured and fragmented internal mass is then flushed from the target's internal cavity by the waterjet and is ejected from the targeted object. The water pressure used in the waterjet lance or wand can be varied so to optimize the fractured particle size of the solid material to be washed out and to minimize damage to the targeted object. A common engineering estimate is that the water pressure before the orifice should be at least three times the tensile yield strength of the material being washed out. For example, materials with tensile yield strength of about 100 MPa should require at least 300 MPa water in the waterjet before the orifice to be efficiently washed out with increasing pressures yielding smaller pieces. In some very small cases, the abrasive waterjet cutting head can act as a waterjet washout tool by shutting off the abrasive feed to the abrasive mixing chamber. The high velocity water jet, from the abrasive waterjet cutting head, will effectively washout small items, but for larger targeted objects a dedicated washout lance, wand, or tool should be used. The directionality of the waterjet lance, wand, or tool must be taken into account when determining which lance, wand, or tool should be used.

The waterjet lance can be positioned directly into the access hole, or it can be articulated so that the lance can be maneuvered to probe or extend into various internal areas of the targeted object. For example, the articulation can be performed by using multiple of nesting hollow cylinders with convex hemispheres on the distal end and concave hemispheres on the proximal end. The high pressure water for the washout operation is piped through the hollow portions of the cylinders. The washout wand is steered by retracing one or more of four steel cable(s), known as a tendon, to cause the distal end of the wand to bend in the direction desired. The articulation can be programmed under the control of a multi-axis computer controlled system or manually controlled by an operator using video feedback and teleoperated using a computer on the surface communicating with the washout wand control system. The control system for the washout wand can be microprocessor controlled, using an Intel i7-2660K processor, etc.

The use of video cameras, also known as closed circuit television, or CCTV, can also be incorporated into the washout head to aid in visual inspection of the surfaces before or after washout. The video cameras are preferably fiber-optically fed images from a distal tip of the washout wand to a camera module located outside of the target housing in a waterproof housing. Illumination can be provided by light emitting diodes (LED) light sources, etc., illuminating the targeted objects' internal cavity or by fiber optic light pipes from external light sources, such as high power LEDs, providing light.

The use of kinematic positioning sensors can be used to allow the computer control system to monitor the progress of the articulated washout wand and provide a visual display of the calculated position on a video monitor, or a human-machine interface (HMI) device. An example of a human-machine interface device is a microprocessor system using software to display video images and graphical icons of the equipment's operational state and feedback on the process parameters. This is generally part of a larger SCADA (supervisory control and data acquisition) process control system that is typically microprocessor based, using microprocessors such as the Intel i7-2660K, etc. The use of high pressure waterjets can provide the targeted objects' internal surface sufficiently clean enough to preclude further decontamination.

The object to be cut can be a munition containing energetic material that in many cases will have to be removed and collected. Non-limiting examples of type of energetic material that are typically found in munitions include ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nitrooxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2.4.6-tetranitrobenzeneamine (Tetryl); 2-methyl-1,3,5-trinitrobenzene (TNT); Amatol (Ammonium Nitrate/TNT); Baratol ($Ba(NO_3)2$/TNT; black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; Octol (HMX/TNT), hexanitrodiphenylamine (HND) and trinitroanisol.

A munition will typically contain one or more fuzes. If there are more than one fuze one will typically be located at the front of the munition and the other at the back. It is preferred that one or both of the fuzes be removed to form an access point to washout the energetic material contained within the munition and recover it for disposal or processing.

Collecting the Washed-Out Contents of the Targeted Object.

Some materials washed out from the targeted object can be valuable and may need to be captured for recovery, or may be harmful and need to be captured for later disposal. Typical concerns for materials that are harmful are those that may be toxic, corrosive, radioactive, or explosive.

In the event the interior material of the targeted object is to be captured and sequestered for later recovery or disposal, the abrasive waterjet cutting head can be attached by use of an obturating seal, or ring, to prevent leakage into the environment. An obturating ring is a ring of relatively soft material designed to obturate under pressure to form a seal. Obturating rings are often found in artillery and other ballistics applications and similar devices are also used in other applications such as plumbing wherein they are often called O-rings. The obturating seal is preferably made of a compliant polymer material capable of being adequately deformed so that any marine growth or irregularity on the surface of the targeted object can be readily accommodated. A preferred seal material is a 20 shore A durometer neoprene rubber that is capable of making a serviceable obturating seal using between 100 and 500 N (22.5 to 112 lbf) of pressure.

The abrasive waterjet mechanism can also have a containment housing that will allow materials ejected by the washout process to flow through an outlet into a collection device. A check valve can be used at the inlet of a collection device to prevent escape of the collected materials into the environment. The collection device can be constructed in several non-limiting ways. For example, a polymer bag, with or without fibrous reinforcement, can be used to capture and sequester effluent liquids and solids. The polymer bag is preferably selected to minimize adverse interaction between the known or suspected contents of the targeted object. It is preferably constructed of layers of different polymers specifically chosen for their attributes, such as inertness to chemicals, tear resistance, strength, cost, etc. Non-limiting examples of such polymers that can be used in the practice of the present invention include: DuPont Tedlar polyvinyl fluoride (PVF) and Viton fluoroelastomer films that provide excellent chemical resistance and strength for such applications. For additional strength, an exterior bag of reinforced polymer, such as used in ATL Flexible Fluid Containment Bladders can be used. The polymer collection bags for the effluent collection device are preferably about 50 microns (2 mil) to about 6.35 mm (250 mil) thick. Similar polymer bags are used by the U.S. military for storing fuels and are known as fuel bladders.

The removal of materials from the targeted object to the collection device can be accomplished by passively using the water from the waterjet to displace the targeted object's contents or to actively use a pump or eductor to remove the contents of the targeted object into the collection device.

If a pump is used, it can be of any suitable type to remove the water used in the washout process and the contents of the targeted object. For example, an eductor style pump can be used employing a constant flow of water either from the local environment or from a recycle loop from an effluent collection device. Also, a pneumatically or hydraulically driven diaphragm pump having one or more chambers, can be used, as well as a progressive cavity pump can be used to pump out the contents of the target item and transfer them into the collection device. Other non-limiting examples of suitable pumps include: a laminar flow disk pump: a lobe pump: a centrifugal pump; a piston pump; and a peristaltic hose pump.

Collection devices can also be made from any suitable material, non-limiting examples which include: plastic, metallic, or composite materials forming rigid or semi-rigid tanks. A non-limiting example is a 200 liter Faber Fibre Steel Composite Cylinder. Such tanks can be sufficiently rigid to allow being in an evacuated state and allowing the contents of the targeted object to be aspirated without the use of a pump. The collection device can be fitted with a moveable diaphragm or membrane that will allow the pumping out of air from one side to form a partial vacuum on the other, allowing effluent to be evacuated from the targeted object without the use of an effluent transfer pump as described above.

These collection devices can also be filled with water and the water utilized as a flush or rinse water to clean the interior of the target item. The removed water can also be used as the motive fluid in an eductor to move the effluent stream from the targeted object. Once inside of the collection device, the washed-out materials can be further stabilized by absorption into a porous material or by using a super absorbent material, etc., to form a gelatinous mass that is resistant to leakage into the environment.

The recovered effluent, once captured in the collection device, can be processed for recovering water from the liquid portion. For example, in the washout of trinitrotoluene (TNT) from DMM, the washout water will not appreciably dissolve the TNT. The TNT will remain as a solid fraction while the washout water will separate into a liquid phase. This liquid phase water can be reused in the washout process even with a small fraction of TNT dissolved in it. Using TNT saturated feed water in the high pressure waterjet intensifier only slightly increases the wear on the check valves and is acceptable. Non-limiting methods for separating solid fractions from liquid fractions include centrifuges and mechanical filters. Not all materials will lend themselves to being readily separated into product and reusable water. However, for those materials that are minimally water soluble, the recovery of process water for reuse in the waterjet or eductor will provide a reduction in stored process water required as well as reducing the amount of waste material that needs to be disposed of. The disposal of waste water and effluents can be performed by recovering the effluents and disposed of using established disposal methods already approved by the environmental protection agency.

What is claimed is:

1. A method for cutting objects located above or underground using an entrainment abrasive waterjet technology, which method comprises:

a) providing a vehicle having multiple systems and an on-board hydraulic unit for operating at least one of its systems;

b) positioning an entrainment abrasive waterjet apparatus comprised of a hydraulically operated intensifier waterjet pump, an entrainment abrasive waterjet cutting head which cutting head comprising a mixing chamber, a process water inlet to said mixing chamber, and an abrasive feed inlet to said mixing chamber, which waterjet cutting head is in fluid communication with said intensifier waterjet pump and in fluid communication with a source of abrasive material via an abrasive inlet line, wherein said intensifier waterjet pump is operated by sharing said on-board hydraulic unit of said vehicle;

c) supplying a flow of water to said intensifier waterjet pump whereby the pressure of the flow of water is increased;

d) supplying a flow of abrasive material to said waterjet cutting head; and e) controlling speed, direction and standoff distance from the object to be cut, of the waterjet cutting head delivering a high velocity jet of water and abrasive to achieve a desired cutting track and rate of cutting of said objects located above or underground.

2. The method of claim 1 wherein the vehicle is an unmanned ground vehicle.

3. The method of claim 2 wherein the unmanned ground vehicle is remotely operated.

4. The method of claim 2 wherein the unmanned ground vehicle is autonomous.

5. The method of claim 2 wherein the unmanned ground vehicle is semi-autonomous.

6. The method of claim 1 wherein the intensifier waterjet pump is driven by us of a hydraulic fluid that is pressurized to a pressure of about 14 MPa to about 105 MPa and conducted to said waterjet pump via a hose to drive said intensifier waterjet pump after which the hydraulic fluid becomes depressurized.

7. The method of claim 6 wherein the hydraulic fluid is a hydraulic oil from said vehicle that is returned to a hydraulic oil reservoir on the vehicle after it becomes depressurized.

8. The method of claim 1 wherein the waterjet pump is within reach of said vehicle which said vehicle is capable of picking up the putting down said waterjet pump.

9. The method of claim 1 wherein the hydraulic power used to power said waterjet pump is supplied via a hot-stab plug of said vehicle having a hydraulic receptacle for a hot-stab plug.

10. The method of claim 1 wherein the abrasive material is metered to the abrasive waterjet cutting head by use of a programmable device that is capable of providing control over the quantity of abrasive material conducted to the abrasive waterjet cutting head.

11. The method of claim 10 wherein the programmable device is an electronic device comprised of a microprocessor-based or discrete-logic control system using either digital or analog logic processing.

12. The method of claim 1 wherein the abrasive material is paramagnetic.

13. The method of claim 1 wherein a feedback loop from an abrasive material mass flow meter to the abrasive control system is used to control the flow of abrasive material to the abrasive waterjet cutting head thereby providing optimum cutting performance and preventing plugging of the abrasive.

14. The method of claim 1 wherein alignment of the waterjet cutting head to the object to be cut is controlled by use of an active terrain following probe.

15. The method of claim 1 wherein the cutting head is controlled by use of a computerized control system that adjusts the height of the abrasive waterjet cutting head as it traverses the targeted object by means of mechanical, hydraulic, pneumatic, or electrical actuators to maintain the optimal standoff distance from the targeted object.

16. The method of claim 15 wherein input to the computerized control system is made by the use of a laser range finder to provide accurate standoff distance of the waterjet cutting head to the targeted object.

17. The method of claim 1 wherein the object has an interior cavity filled with material to be removed.

18. The method of claim 17 wherein an access hole is cut in the targeted object by cutting out a plug from the targeted object by use of a jet of water plus from the abrasive waterjet cutting head to expose the interior cavity of said object.

19. The method of claim 18 wherein the material within the object's cavity is washed out by use of a waterjet using water alone without abrasive.

20. The method of claim 1 wherein the abrasive is selected from the group consisting of glass, silica, alumina, silicon carbide aluminum-based materials, garnet, elemental metal and metal alloy slags and grits.

21. The method of claim 1 wherein plugging of the abrasive material is mitigated by use of a continuous loop wherein abrasive material from an abrasive feed and metering system to the waterjet cutting head returns a portion of the abrasive material before it is introduced into the cutting head and returns it to the feed and metering system.

22. The method of claim 1 wherein plugging of the abrasive material is mitigated by use of a vibration device attached to the abrasive waterjet cutting head.

23. The method of claim 1 wherein plugging of the abrasive material is mitigated by use of a sensor that is capable of detecting a loss of vacuum at the mixing chamber of the cutting head and causes the injection of a stream of supplemental water into the process water inlet to said mixing chamber of said cutting head.

24. The method of claim 1 wherein plugging of the abrasive material is mitigated by use of a sensor that is capable of detecting a loss of vacuum at the mixing chamber of the cutting head and causes a vacuum to be pulled in the abrasive inlet line upstream of the cutting head.

25. The method of claim 1 wherein the object is a munition containing an energetic material.

26. The method of claim 25 wherein the munition is oblong in shape and has a fuze on one or both ends.

27. The method of claim 26 wherein at least one of the fuzes is cut out of said munition by use of the waterjet.

28. The method of claim 25 wherein the energetic material is selected from the group consisting of ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nitrooxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2.4.6-tetranitrobenzeneamine (Tetryl); 2-methyl-1,3,5-trinitrobenzene (TNT); (Ammonium Nitrate/TNT); Baratol ($Ba(NO_3)2$/TNT; black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; Octol (HMX/TNT), hexanitrodiphenylamine (HND) and trinitroanisol.

* * * * *